US012471617B2

(12) United States Patent
Lauenstein et al.

(10) Patent No.: US 12,471,617 B2
(45) Date of Patent: Nov. 18, 2025

(54) METHOD FOR PRODUCING A BOBBIN INCLUDING A MATERIAL CONTAINING ALKALOIDS

(71) Applicant: PHILIP MORRIS PRODUCTS S.A., Neuchatel (CH)

(72) Inventors: Stefan Lauenstein, Cormondreche (CH); Bertrand Barbou Des Courieres, Peseux (CH); Marc A.F. Van Den Boogaart, Giez (CH)

(73) Assignee: Philip Morris Products S.A., Neuchatel (CH)

( * ) Notice: Subject to any disclaimer, the term of this patent is extended or adjusted under 35 U.S.C. 154(b) by 938 days.

(21) Appl. No.: 17/251,860

(22) PCT Filed: Jun. 28, 2019

(86) PCT No.: PCT/EP2019/067420

§ 371 (c)(1),
(2) Date: Dec. 14, 2020

(87) PCT Pub. No.: WO2020/002646

PCT Pub. Date: Jan. 2, 2020

(65) Prior Publication Data

US 2021/0244074 A1 Aug. 12, 2021

(30) Foreign Application Priority Data

Jun. 29, 2018 (EP) ..... 18181034

(51) Int. Cl.
*A24B 3/14* (2006.01)
*A24B 15/14* (2006.01)
*A24C 5/01* (2020.01)

(52) U.S. Cl.
CPC ..... *A24B 3/14* (2013.01); *A24B 15/14* (2013.01); *A24C 5/01* (2020.01)

(58) Field of Classification Search
CPC ..... A24B 3/14; A24B 15/14; A24C 5/01
See application file for complete search history.

(56) References Cited

U.S. PATENT DOCUMENTS 3,472,236 A 10/1969 Dearsley
4,047,536 A 9/1977 Asfour
(Continued)

FOREIGN PATENT DOCUMENTS

JP 2011500021 1/2011
JP 51012999 12/2012
(Continued)

OTHER PUBLICATIONS

Office Action issued in Japan for Application No. 2020-568447 dated Apr. 13, 2023 (6 pages). English translation included.
(Continued)

*Primary Examiner* — Michael H. Wilson
*Assistant Examiner* — Jennifer A Kessie
(74) *Attorney, Agent, or Firm* — Mueting Raasch Group

(57) ABSTRACT

The present invention is related to a method for producing a bobbin the method comprising the steps of: —providing a web (210) of a material containing alkaloids, wherein the web of a material containing alkaloids contains at least about 5 percent in dry weight basis of an aerosol-former; —feeding the web (210) of a material containing alkaloids to an embossing device in a transport direction; —embossing the web (210) of a material containing alkaloids to form an embossed web (220) of a material containing alkaloids; —winding the embossed web (220) of a material containing alkaloids in a bobbin (200).

12 Claims, 2 Drawing Sheets

(56) References Cited

U.S. PATENT DOCUMENTS

| | | | |
|---|---|---|---|
| 2010/0247612 | A1 | 9/2010 | Fuisz |
| 2015/0150302 | A1 | 6/2015 | Metrangolo |

FOREIGN PATENT DOCUMENTS

| | | |
|---|---|---|
| JP | 2015517817 | 6/2015 |
| WO | WO 2016/050472 | 4/2016 |
| WO | WO 2017/041920 | 3/2017 |
| WO | WO 2017/089545 | 6/2017 |

OTHER PUBLICATIONS

Search Report and Written Opinion for PCT/EP2019/067420 dated Sep. 25, 2019 (13 pages).
PCT International Preliminary Report on Patentability for PCT/EP2019/067420 dated Oct. 16, 2020 (11 pages).
Office Action issued in Brazil for Application No. BR112020026491-1 dated Apr. 8, 2025 (7 pages).

METHOD FOR PRODUCING A BOBBIN INCLUDING A MATERIAL CONTAINING ALKALOIDS

This application is a U.S. National Stage Application of International Application No. PCT/EP2019/067420 filed Jun. 28, 2019, which was published in English on Jan. 2, 2020 as International Publication No. WO 2020/002646 A1. International Application No. PCT/EP2019/067420 claims priority to European Application No. 18181034.2 filed Jun. 29, 2018.

The present invention is related to a method for producing a bobbin including a material containing alkaloids, such as homogenized tobacco material, and to a method for producing an aerosol generating article including the step of unwinding said bobbin.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The starting material for the production of homogenized tobacco material for aerosol-generating article may also be mostly tobacco leaves that have thus the same size and physical properties as the tobacco for the blending of cut filler.

Possible forms of homogenized tobacco material include reconstituted tobacco sheet and cast leaf. The process to form homogenized tobacco material sheets commonly comprises a step in which ground tobacco and a binder are mixed to form a slurry. The slurry is then used to create a tobacco web or sheet, for example by casting a viscous slurry onto a moving metal belt to produce so called cast leaf. Alternatively, a slurry with low viscosity and high water content can be used to create reconstituted tobacco in a process that resembles paper-making.

The sheet or web of homogenized tobacco material is then rolled in bobbins which need to be unwound in order to be further processed and included in the aerosol-forming substrate of the aerosol-forming article.

Typically, aerosol-generating articles comprise a plurality of elements assembled in the form of a rod, including an aerosol-forming substrate. The aerosol-forming substrate may comprise a plurality of channels to provide air-flow through the rod. The channels affect the contact between the air, penetrating the aerosol-generating article, and the aerosol-forming substrate, as well as the resistance to draw (RTD) experienced by the user.

It may be desired to improve or modify the process to form an aerosol-forming substrate of the aerosol-forming article including a homogenized tobacco material in terms of its productivity as well as of the users' smoking experience of the aerosol generated from the homogenized tobacco material of the aerosol-forming substrate.

Indeed, unwinding bobbins including a web of homogenized tobacco material can be a difficult task. The homogenized tobacco material sheet or web, when coiled in bobbins, may be indeed difficult to unwind due to its consistency, sensitivity to heat, stickiness and low tensile strength: it could easily be torn apart and, if too high forces are used to un-stuck the sheets or webs, the same could break, thus negatively affecting the productivity of the rest of the production line.

Additionally, these bobbins may be difficult to transport. Moreover, they are currently used within a very short timeframe from their production, since otherwise the sheets or webs of homogenized tobacco materials bind together and compromise unwinding. Consequently, building up a safety-stock of such bobbins can be a difficult task as well.

Furthermore, the pattern of the channels in the aerosol-forming substrate that provide air-flow through the rod may limit the contact between the air and the aerosol-forming substrate, for example lowering the efficiency of the air flow through the aerosol-generating article, in turn limiting the release of substances from the homogenized tobacco material of the aerosol-forming substrate to the air, or adversely affecting the RTD (resistance to draw) value experienced by the user.

There is therefore a need for a method for producing a bobbin including a material containing alkaloids, such as homogenized tobacco material, that may satisfy at least one of the above needs in terms either of productivity and/or of users' smoking experience of the aerosol generated from the material containing alkaloids included in the aerosol-forming substrate.

Among others, there is a need for a method for producing a bobbin including a material containing alkaloids, such as homogenized tobacco material, that is easily unwound and transported, in particular when needed, and that therefore allows providing a continuous, constant and regular feed of material so that the rest of the production line can increase the overall production rate.

There is also a need for a method for producing a bobbin including a material containing alkaloids such that the material may be easily included into an aerosol-forming substrate of an aerosol generating article and may be used to obtain a desired contact between the air flowing through the aerosol-generating article and the aerosol-forming substrate including the material containing alkaloids.

The invention may satisfy at least one of the above needs.

In an aspect, the invention relates to a method for producing a bobbin, the method comprising the steps of: providing a web of a material containing alkaloids, wherein the web of a material containing alkaloids contains at least about 5 percent in dry weight basis of an aerosol-former; feeding the web of a material containing alkaloids to an embossing device in a transport direction; embossing the web of a material containing alkaloids to form an embossed web of a material containing alkaloids; winding the embossed web of a material containing alkaloids in a bobbin.

The invention may also relate to a method for producing a bobbin, the method comprising the steps of: providing a web of a material containing alkaloids; feeding the web of a material containing alkaloids to an embossing device in a transport direction; embossing the web of a material containing alkaloids to form an embossed web of a material containing alkaloids; winding the embossed web of a material containing alkaloids in a bobbin.

In the method of the invention, a web of a material containing alkaloids is provided. The web contains a given amount of aerosol-former, equal to or greater than about 5 percent in dry weight basis. The amount of aerosol former causes the web to be "sticky". The web is fed in a transport direction to an embossing device that applies an embossing pattern in the web, thus forming an embossed web of a material containing alkaloids. The embossed web including the material containing alkaloids may then be wound up into a bobbin comprising a plurality of layers of said embossed web one above the others. The adhesion between two consecutive layers of said embossed web may be reduced in view of the reduction of the surface contact between them and in this way the bobbin may be easily unwound. Therefore, although the web is sticky, the adhesion among layers is reduced by the embossing and the unwinding becomes relatively easy or requires smaller forces.

The unwinding of the bobbin including the material containing alkaloids or the feeding of the same into the rest of the production line is thus possibly facilitated.

Furthermore, the embossed web, once unwound from the bobbin thus obtained, may be gathered into a rod for producing an aerosol generating article including an aerosol-forming substrate that includes it. The air flowing through the aerosol-generating article may be influenced in view of the embossing pattern of the embossed web and in this way a desired contact between the air and the material containing alkaloids included in the aerosol-forming substrate may be obtained.

The users' smoking experience of the aerosol generated from the material containing alkaloids is thus possibly improved.

As used herein, the terms "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters. A continuous "sheet" is herein called "web".

As used herein, the term "embossed" denotes a way to form a raised pattern on a surface. In "embossing", a design is formed, for example carved, moulded, stamped or others, on a surface of a sheet so that it stands out in relief. The embossed pattern includes a plurality of protrusions (also called bumps) on at least one of the sheet's surfaces. For example, the embossing process may form a plurality of peaks and valleys on the surface. Alternatively, a plurality of raised structures on an otherwise flat surface can be obtained.

As a possible embossing step, a crimping step is used. In a crimping step, two rollers are used, which form a gap therebetween. In the gap, the web of material containing alkaloids is introduced. Preferably, the width of the gap is smaller than the thickness of the sheet. At least one of the rollers includes a given pattern on its surface. When the web is introduced in the gap, the pattern is transferred into the surface(s) of the web, forming thus the "protrusions".

A common pattern includes a plurality of ridges and valleys (or trough) parallel to each other.

As used herein, the expression "ridges and/or troughs" denotes a plurality of protrusions alternatively extending outwardly and/or inwardly in a direction orthogonal to the surface of the sheet or web, thus forming a tip and/or a bottom that may have either a corner-type shape or a rounded shape. For example, when a plurality of ridges and troughs alternate each other on the surface of a sheet, the sheet may show a wavy profile, when observed in a direction parallel to its surface.

As used herein, the term "amplitude value" or "amplitude" denotes the distance between the lowermost and the uppermost point of the web's surface including a given embossing pattern in a direction perpendicular to the transport direction. For example, when the embossing pattern includes a plurality of ridges and valleys (or trough), the amplitude denotes the distance between the lowermost and the uppermost point of the ridges and/or troughs in a direction perpendicular to the transport direction.

As used herein, the term "pitch value" or "pitch" denotes the distance between two consecutive protrusions, for example two consecutive ridges or troughs, in a direction parallel to the transport direction.

As used herein, the term "rod" denotes a generally cylindrical element of substantially circular or oval cross-section.

As used herein, the terms "gathered" or "gathering" denote that a web or sheet is convoluted, or otherwise compressed or constricted substantially transversely to the cylindrical axis of the rod.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein, the term "homogenised tobacco material" denotes material formed by agglomerating particulate tobacco, which contains the alkaloid nicotine. The material containing alkaloids can thus be a homogenized tobacco material.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The homogenized tobacco sheet can be also referred to as a reconstituted sheet material and formed using particulate tobacco (for example, reconstituted tobacco) or a tobacco particulate blend, a humectant and an aqueous solvent to form the tobacco composition. This tobacco composition may be then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The sheet or web of homogenized tobacco material may be then rolled in bobbins which need to be unwound in order to be further processed, to be part for example of an aerosol-forming article, that is to be included in the aerosol-forming substrate of the aerosol-forming article. In a "heat-not-burn" aerosol-generating article, an aerosol-forming substrate is heated to a relatively low temperature, in order to form an aerosol but prevent combustion of the tobacco material. Further, the tobacco present in the homogenized tobacco sheet or web is typically the only tobacco, or includes the majority of the tobacco, present in the homogenized tobacco material of such a "heat-not-burn" aerosol-generating article. This means that the aerosol composition that is generated by such a "heat-not-burn" aerosol-generating article is substantially only based on the homogenized tobacco material.

As used herein, the term "aerosol forming material" denotes a material that is capable of releasing volatile compounds upon heating to generate an aerosol. Tobacco, together with other compounds, may be classed as an aerosol forming material, particularly a sheet of homogenized tobacco comprising an aerosol former. An aerosol forming substrate may comprise or consist of an aerosol forming material.

The homogenized tobacco sheet generally includes, in addition to the tobacco, a binder and an aerosol-former, such as guar and glycerin. This composition leads to a sheet which may be "sticky", that is, it glues to adjacent objects, and at the same time it is rather fragile having a relatively low tensile strength. Once a sheet or web of material containing alkaloids is produced, such as a sheet or web of homogenized tobacco material, it often needs to be stored at least for a certain time before it is further processed. In order to store it properly, without or with minimal risks of breakage or without occupying too much space, it is commonly wound into bobbins. However, winding the alkaloids containing sheet or web in a bobbin as such may create several problems in the subsequent unwinding, due to the "sticky" properties of the sheets or webs. Due to the fact that the alkaloids containing sheet or web is sticky, the layers formed in the bobbin by the sheet or web wound in itself are prone to glue one onto the others, preventing unwinding.

The web of material containing alkaloids contains at least about 5 percent of aerosol-former in dry weight basis of the web of material containing alkaloids. Preferably, the web of material containing alkaloids contains at least about 10 percent of aerosol-former in dry weight basis of the web of material containing alkaloids. More preferably, the aerosol-former includes glycerine. Glycerine is also called glycerol.

According to the method of the invention, a web of a material containing alkaloids is provided.

The web is fed to an embossing device in a transport direction.

The embossing device applies an embossing pattern on the web, thus forming an embossed web of a material containing alkaloids. The embossed web thus obtained may be wound up into a bobbin comprising a plurality of layers of said embossed web one above the others. The layers of said embossed web mutually at least partially stick to each other while wound in the bobbin. Without willing to be bound to any specific theory, it is believed that the adhesion between two consecutive layers of the bobbin may depend, among others, on the extension of the contact surface, also called contact area, between them.

The embossing pattern includes a plurality of protrusions and may be transferred into at least one of the web's surfaces for example by passing the web between two rollers which form a gap therebetween and in which at least one of the rollers includes a given pattern on its surface or by applying on at least one of the web's surfaces a pressing means including a patterned surface portion facing the surface.

The embossing pattern of the web may reduce the amount of contact surface between two consecutive layers of the bobbin, thus facilitating the unwinding of the bobbin, in particular due to the fact that the web is "sticky".

Consequently, the use of such a roller of embossed web into the downstream steps of the rest of the production line is possibly facilitated and the productivity of a method for producing an aerosol generating article including a component, such an aerosol-forming substrate, deriving from or including said web may therefore be also improved.

The embossed web unwound from the bobbin produced according to the method of the invention may be gathered into a rod for producing an aerosol generating article.

Within the rod, the embossed web is included in the aerosol-forming substrate and, to this purpose, it is folded on itself so that a plurality of channels may be formed. During the users' smoking experience, air flows through the rod of the aerosol generating article and enters into contact with the web of the material containing alkaloids included in the aerosol-forming substrate. The embossing pattern present in the web may influence the flow of the air through the rod of the aerosol generating article and may modify the extent of the contact between the air and the aerosol-forming substrate including the material containing alkaloids. In this way, a desired contact between the air and the material containing alkaloids may be obtained and the users' smoking experience of the aerosol generated from the aerosol-forming substrate including the material containing alkaloids is thus possibly improved.

Preferably, the method of the invention comprises the step of unwinding a mother bobbin comprising a wound web of a material containing alkaloids in such a way to provide the web of a material containing alkaloids.

In this way, the method of the invention may also be used for producing bobbins comprising a plurality of windings of an embossed web, even starting from previously prepared bobbins of alkaloids containing materials. Preferably, this step of unwinding a mother bobbin takes place before providing a web of a material containing alkaloids.

Preferably, the embossing device includes at least one component including a surface facing at least one of the web's surfaces and adapted to transfer the embossing pattern to the web.

Preferably, in the method of the invention, the step of embossing comprises feeding the web of a material containing alkaloids between a first and a second embossing rollers so that the first and second embossing rollers apply an embossing pattern to at least a surface of the web.

Preferably, the embossing pattern includes a plurality of protrusions applied on at least a surface of the web. More preferably, the plurality of protrusions includes ridges and/or troughs, even more preferably, the ridges and/or troughs extend in a direction orthogonal or parallel to the transport direction. Even more preferably, the plurality of protrusions includes ridges and/or troughs extending along more than one direction, for example a first group extends in a direction parallel to a transport direction and a second group extends in a direction perpendicular to the transport direction, forming a "grid" or "matrix" pattern on the web.

Preferably, the plurality protrusion are transferred on at least one of the web's surfaces by at least one component of the embossing device including a surface facing at least one of the web's surfaces. Preferably, the component of the embossing device including a surface facing at least one of the web's surfaces is an embossing roller.

Preferably, the embossing process is rather similar to a crimping process. The web of material containing alkaloids is fed through two rollers. Each roller or at least one of the rollers includes a pattern engraved in its surface. In the crimping or embossing process, the pattern is transferred onto the surface(s) of the web which is introduced in a gap formed between the two rollers.

In this way, the extension of the contact surface between the windings of embossed web of the material containing alkaloids, when wounded to form the layers of the bobbin produced according to the method of the invention, may be regulated and the adhesion between them may be minimized.

Preferably, an amplitude of the plurality of protrusions is comprised between about 10 and about 150 percent of the thickness of the web, more preferably between about 25 and about 75 percent of the thickness of the web.

This amplitude has proven to be optimal to obtain the desired characteristics in the bobbin. For example, the desired reduction of adhesion between the layers including the web and a desired contact between the air flowing through the rod and the aerosol generating substrate including the web of material containing alkaloids is obtained.

Preferably, the plurality of protrusions has a pitch comprised between about 100 and about 500 percent of the thickness of the web, more preferably between about 200 and about 300 percent of the thickness of the web.

This pitch has proven to be optimal to obtain the desired characteristics in the bobbin. For example, the desired reduction of adhesion between the layers of the bobbin and a desired contact between the air flowing through the rod and the aerosol generating substrate including the web of material containing alkaloids are obtained.

Preferably, the web of a material containing alkaloids has a thickness of between about 100 micron and about 300 micron. Preferably, the thickness of the web of a material containing alkaloids is the "standard" thickness used for the production of aerosol generating articles, for example of about 200 micron. There is no need of modifying standard process steps.

Preferably, the web of a material containing alkaloids has a width comprised between about 0.1 meters and about 2 meters.

Preferably, the method of the invention comprises the step of cutting said web of a material containing alkaloids in a direction which is substantially parallel to the transport direction and perpendicular to the width of the web, in such a way to provide two partial webs of a material containing alkaloids. In this way, a web is preferably divided in two by cutting two distinct partial webs, each having a width smaller than the width of the web before cutting.

Preferably, the above described cutting step takes place before the step of embossing the web of a material containing alkaloids. In this way, two different embossed partial webs could be formed in parallel along the production line, thus furthermore increasing the overall productivity of the process.

Preferably, in the method of the invention, the step of winding the embossed web comprises: feeding the embossed web to a rotatable center core; and rotating the rotatable center core so as to wind the embossed web around it to form the bobbin.

Preferably, the embossed web is fed to said rotatable center core at a speed comprised between about 10 meters/minute and about 500 meters/minute. Preferably, this step takes place while feeding the embossed web to a rotatable center core. A relatively high speed of production is thus obtained.

Preferably, in the step of rotating the rotatable center core so as to wind the embossed web around it to form the bobbin, the rotation speed of said rotatable center core is set in such a way that a linear speed of material comprised between about 10 meters/minute and about 500 meters/minute is obtained.

Preferably, in the method of the invention, the material containing alkaloids is a tobacco material. More preferably it is a homogenized tobacco material. Preferably, the material containing alkaloids may contain a single alkaloid, or more than a single alkaloid. Preferably, the alkaloids include tobacco.

Preferably, the web of a material containing alkaloids has a moisture content comprised between about 7 percent and about 15 percent in total weight basis of the web. At this moisture content, the web is substantially solid and relatively easy to handle.

Preferably, the web of a material containing alkaloids comprises: particles of the material containing alkaloids having a mean size per weight comprised between about 0.03 millimetres and about 0.12 millimetres; a binder; and water.

Preferably, the web of a material containing alkaloids comprises from about 1 percent and about 5 percent in dry weight basis of the binder. More preferably, it is comprised between about 2 percent and about 4 percent.

Preferably, the web of a material containing alkaloids comprises from about 45 percent and about 93 percent in dry weight basis of the particles of a material containing alkaloids.

Preferably, the web of a material containing alkaloids comprises from about 1 percent to about 7 percent per weight on a dry weight basis of cellulose fibres. More preferably, the cellulose fibres have a mean length comprised between about 0.2 millimetres and about 4 millimetres.

Preferably, the web of a material containing alkaloids comprises between about 5 percent and about 30 percent in dry weight basis of the aerosol-former. More preferably, the web of a material containing alkaloids comprises between about 10 percent and about 30 percent in dry weight basis of the aerosol-former. More preferably, the aerosol-former is comprised between about 10 percent to about 25 percent in dry weight basis of the web. More preferably, the aerosol-former is comprised between about 15 percent to about 25 percent in dry weight basis of the web.

More preferably, the aerosol-former includes glycerine.

According to a second aspect, the invention relates to a method for producing an aerosol generating article including the step of unwinding the bobbin realized according to the first aspect of the invention.

The advantages of the second aspect have been already outlined with reference to the first aspect and are not repeated herewith.

Aerosol forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material without combustion or heating.

Aerosol forming articles according to the invention may be whole, assembled aerosol forming articles or components of aerosol forming articles that are combined with one or more other components in order to provide an assembled article for producing an aerosol, such as for example, the consumable part of a heated smoking device.

An aerosol forming article may be an article that generates an aerosol that is directly inhalable into a user's lungs through the user's mouth. An aerosol forming article may resemble a conventional smoking article, such as a cigarette and may comprise tobacco. An aerosol forming article may be disposable. An aerosol forming article may alternatively be partially-reusable and comprise a replenishable or replaceable aerosol forming substrate.

An aerosol forming article may also include a combustible cigarette. In preferred embodiments, the aerosol forming-article may be substantially cylindrical in shape. The aerosol forming article may be substantially elongated. The aerosol forming article may have a length and a circumference substantially perpendicular to the length. The aerosol forming article may have a total length between approximately about 30 millimeters and approximately about 100 millimeters. The aerosol forming article may have an external diameter between approximately about 5 millimeters and approximately about 12 millimeters.

In all aspects of the invention, preferably, the web of a material containing alkaloids may be a homogenized tobacco web, where the material containing alkaloids is tobacco containing nicotine.

Preferably, the homogenized tobacco web is obtained casting a slurry.

The homogenized tobacco web includes tobacco particles grinded from tobacco leaves (for example tobacco stem and lamina).

The homogenized tobacco web may also comprise a minor quantity of one or more of tobacco dust, tobacco fines, and other particulate tobacco by-products formed during the treating, handling and shipping of tobacco.

The tobacco present in the homogenized tobacco material may constitute the majority of the tobacco, or even substantially the total amount of tobacco present in the aerosol-generating article. The impact on the characteristics of the aerosol, such as its flavour, may derive predominantly from the homogenized tobacco material. It is preferred that the release of substances from the tobacco present in the homogenized tobacco material is simplified, in order to optimize use of tobacco. In the following, the term "tobacco particles" is used through the specification to indicate tobacco having a mean size per weight between about 0.03 millimetres and about 0.12 millimetres.

Tobacco particles having a mean particle size by weight between about 0.03 millimetres and about 0.12 millimetres may improve the homogeneity of the slurry. The quantity of binder added to the blend of one or more tobacco types is preferably comprised between about 1 percent and about 5 percent in dry weight of the slurry. The binder used in the slurry may be any of the gums or pectins described herein. The binder may ensure that the tobacco powder remains substantially dispersed throughout the homogenized tobacco web. For a descriptive review of gums, see Gums And Stabilizers For The Food Industry, IRL Press (G.O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

The homogenized tobacco material comprises preferably between about 45 percent and about 93 percent in dry weight basis of tobacco particles.

Preferably, the homogenized tobacco sheet also includes a binder.

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Preferably, binder is in an amount comprised between about 1 percent and about 5 percent in dry weight basis of the homogenized tobacco web. More preferably, it is comprised between about 2 percent and about 4 percent.

Preferably, the homogenized tobacco web also includes cellulose fibers, in addition to the cellulose fibers already present in the tobacco.

Cellulose fibres may be introduced in the slurry. The introduction of cellulose fibres in the slurry typically increases the tensile strength of the tobacco material web, acting as a strengthening agent. Therefore, adding cellulose fibres may increase the resilience of the homogenized tobacco material web.

Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof.

Cellulose fibres may include tobacco stem materials, stalks or other tobacco plant material. Preferably, cellulose fibres such as wood fibres comprise a low lignin content. Alternatively fibres, such as vegetable fibres, may be used either with the above fibres or in the alternative, including hemp and bamboo.

The length of cellulose fibres is advantageously between about 0.2 millimetres and about 4 millimetres. Preferably, the mean length per weight of the cellulose fibres is between about 1 millimetre and about 3 millimetres.

Further, preferably, the amount of the cellulose fibres is comprised between about 1 percent and about 7 percent in dry weight basis of the total weight of the slurry (or homogenized tobacco web).

Advantageously, the method comprises the step of adding an aerosol-former to the slurry. Suitable aerosol-formers for inclusion in slurry for homogenised tobacco material are known in the art and include, but are not limited to: monohydric alcohols like menthol, polyhydric alcohols, such as triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol-formers are glycerin and propylene glycol.

The homogenized tobacco material may have an aerosol-former content of greater than about 5 percent on a dry weight basis. The homogenized tobacco material may alternatively have an aerosol former content of between about 5 percent and about 30 percent by weight on a dry weight basis. More preferably, the aerosol-former is comprised between about 10 percent to about 25 percent of dry weight of the homogenized tobacco material. More preferably, the aerosol-former is comprised between about 15 percent to about 25 percent of dry weight of the homogenized tobacco material.

The binder and the cellulose fibers are preferably included in a weight ratio comprised between about 1:7 and about 5:1. More preferably, the binder and the cellulose fibers are included in a weight ratio comprised between about 1:1 and about 3:1.

The binder and the aerosol-former are preferably included in a weight ratio comprised between about 1:30 and about 1:1. More preferably, the binder and the aerosol-former are included in a weight ratio comprised between about 1:20 and about 1:4.

The binder and the tobacco particles are preferably included in a weight ratio comprised between about 1:100 and about 1:10. More preferably, the binder and the tobacco particles are included in a weight ratio comprised between about 1:50 and about 1:15, even more preferably between about 1:30 and 1:20.

The aerosol-former and the tobacco particles are preferably included in a weight ratio comprised between about 1:20 and about 1:1. More preferably, the aerosol-former and the tobacco particles are included in a weight ratio comprised between about 1:6 and about 1:2.

The aerosol former and the cellulose fibres are preferably included in a weight ratio comprised between about 1:1 and about 30:1. More preferably, the aerosol-former and the cellulose fibres are included in a weight ratio comprised between about 5:1 and about 15:1.

The cellulose fibres and the tobacco particles are preferably included in a weight ratio comprised between about 1:100 and about 1:10. More preferably, the cellulose fibres and the tobacco particles are preferably included in a weight ratio comprised between about 1:50 and about 1:20.

The above mentioned weight ratios of the ingredients of the homogenized tobacco web are applicable not only to the homogenized tobacco web, but also they are the weight ratios of the various ingredients present in the slurry. A web of homogenized tobacco material is preferably formed by a casting process of the type generally comprising casting a tobacco slurry onto a moving metal belt. Preferably, the cast web is dried to form a web of homogenized tobacco material and it is then removed from the support surface.

The invention also relate to a bobbin formed by an embossed wound web of a material containing alkaloids realized according to the method above detailed.

In an aspect, the invention may also relate to a method for producing a bobbin, the method comprising the steps of: providing a web of a material; feeding the web of a material to an embossing device in a transport direction; embossing the web of a material to form an embossed web; winding the embossed web in a bobbin.

Specific embodiments of the invention will be further described, by way of example only, with reference to the accompanying drawings in which.

Figure 2:
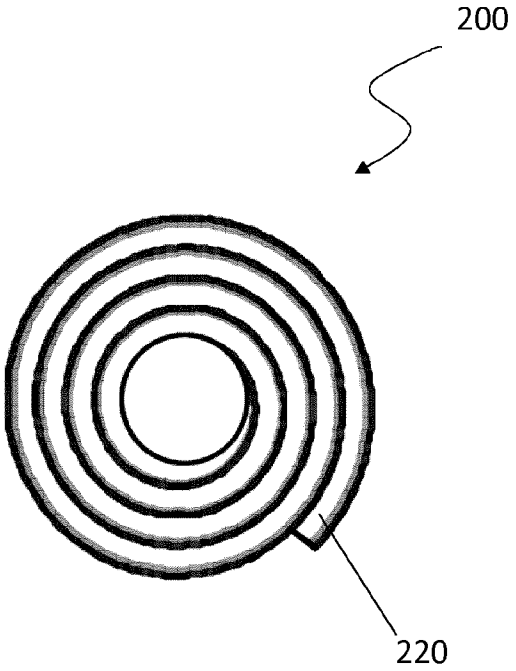
FIG. 2 is a lateral schematic view of a bobbin produced according to the method of the invention.
Figure 1:
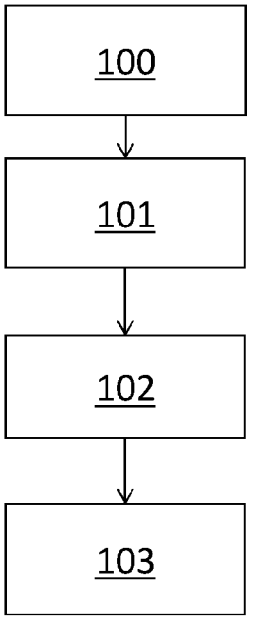
FIG. 1 shows a flow diagram of the method of the invention to produce a bobbin.
Figure 4:
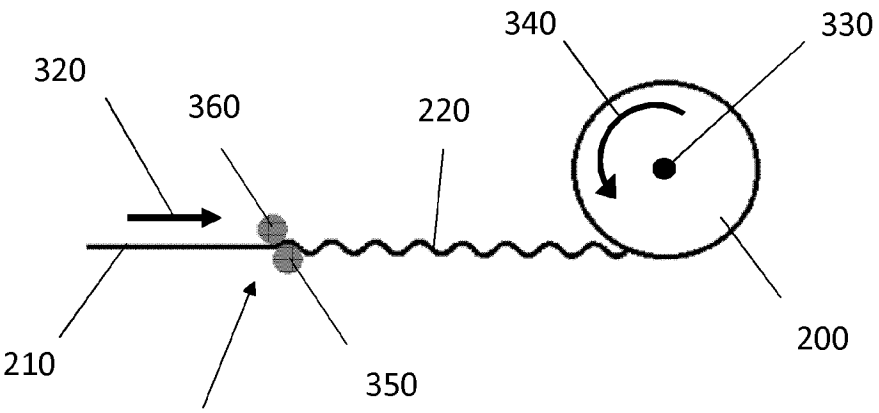
FIG. 4 is a lateral schematic view of an apparatus for carrying out the method of the invention to produce a bobbin.

With initial reference to FIGS. 1, 2 and 4, a method for producing a bobbin 200 (visible in FIG. 2) of the invention is represented.

The first step 100 of the method of the invention includes the provision of a web 210 of a material containing alkaloids (visible in FIG. 4). Material containing alkaloids to be used in the method of the invention preferably includes a homogenized tobacco material. Preferably, in step 100, the homogenized tobacco web 210 has a thickness of between about 100 micron and about 300 micron and a width from between about 0.1 meters to about 2 meters.

Figure 3:
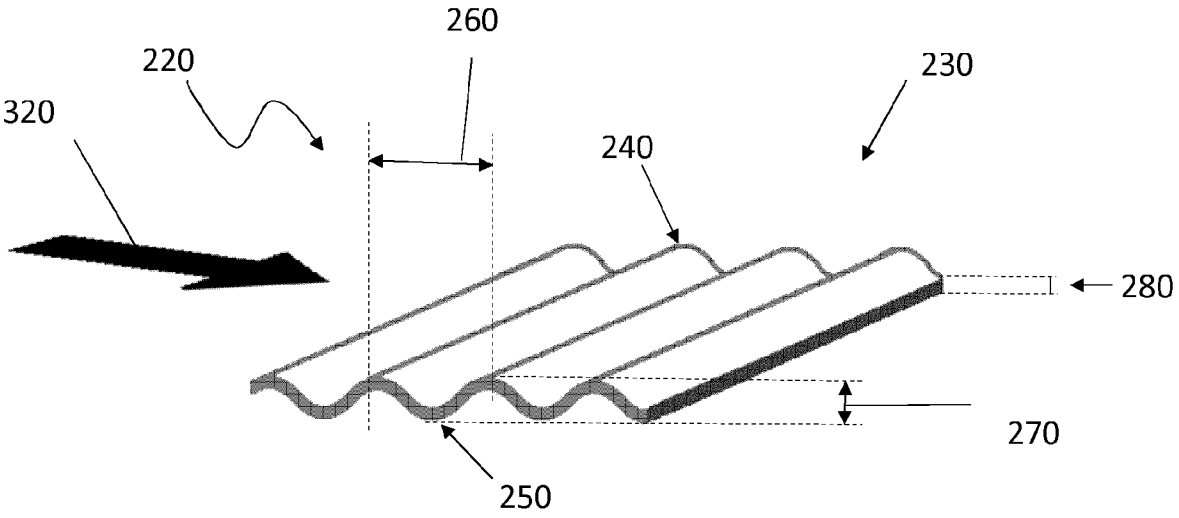
FIG. 3 is a perspective schematic view of an embossed web of a material containing alkaloids obtained from the embossing step of the method of the invention.

The method includes a further step 101 in which the web 210 is fed to an embossing device 310 (visible in FIG. 4) in a transport direction 320 (indicated by an arrow in FIGS. 3 and 4).

Further, the method of the invention includes a step 102 of embossing the web 210 of a material containing alkaloids to form an embossed web 220 of a material containing alkaloids.

Preferably, step 102 of embossing comprises feeding the web 210 between a first and a second embossing rollers (indicated by 350, 360 in FIG. 4) of the embossing device 310, that apply an embossing pattern (indicated by 230 in FIG. 3) to at least a surface of the web, as shown in more detail in FIG. 3.

Preferably, the embossing pattern includes a plurality of protrusions 240, 250 applied on at least a surface of the web. Preferably, an amplitude of the plurality of protrusions is comprised between about 10 and about 150 percent of the thickness 280 of the web.

Preferably, the plurality of protrusions 240, 250 has a pitch comprised between about 100 and about 500 percent of the thickness 280 of the web.

After step 102, the method of the invention includes a step 103 in which the embossed web 220 of a material containing alkaloids is wound up to form a bobbin 200.

In FIG. 2, a lateral schematic view of the bobbin 200 realized according to the method of the invention is shown.

In FIG. 3, a perspective schematic view of an embossed web 220 of a material containing alkaloids obtained from the embossing step of the method of the invention is shown.

The embossed web 220 has a thickness 280 and an embossing pattern 230 applied on it.

The embossing pattern 230 includes a ridge 240 and a trough 250 having an amplitude 270 comprised between about 10 and about 150 percent of the thickness 280 of the web and a pitch 260 comprised between about 100 and about 500 percent of the thickness 280 of the web.

Figure 5:
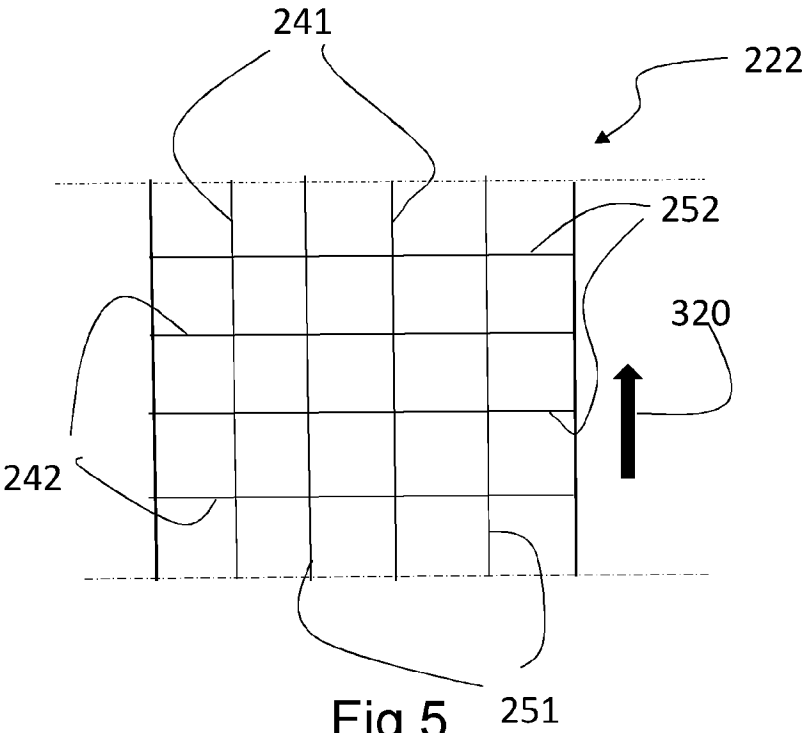
FIG. 5 is a top view of an embossed web of a material containing alkaloids obtained from the embossing step of the method of the invention according to a second embodiment.

In FIG. 5 an additional embossed web 222 is disclosed in a top view, where a "matrix" of ridges and troughs are formed. A first plurality of ridges 241 and troughs 251 extends along the transport direction 320, while a second plurality of ridges 242 and troughs 252 extends in a direction perpendicular to the transport direction, forming a grid pattern.

In FIG. 4 an apparatus 300 for carrying out the method of the invention to produce a bobbin 200 is shown.

The apparatus 300 includes an embossing device 310 and a rotatable center core 330.

The embossing device 310 includes a first and a second embossing rollers 350, 360.

The web 210 of a material containing alkaloids is fed between the first and a second embossing rollers 350, 360 of the embossing device 310 in a transport direction, indicated by arrow 320.

At the exit of the embossing device 310, an embossed web 220 of a material containing alkaloids is obtained.

The embossed web 220 is then fed to the rotatable center core 330.

Rotatable center core 330 rotates in the sense indicated by arrow 340, so embossed web 220 is wound around rotatable center core 330, forming the bobbin 200 comprising a plurality of windings of the embossed web 220 of a material containing alkaloids.

The invention claimed is:

1. A method for producing a bobbin of a cast leaf, the method comprising the steps of:

unwinding a mother bobbin comprising a wound web of a material containing alkaloids in such a way to provide a web of a material containing alkaloids, wherein the web of a material containing alkaloids contains between 10 percent and 25 percent in dry weight basis of an aerosol-former;

feeding the web of a material containing alkaloids to an embossing device in a transport direction;

embossing the web of a material containing alkaloids to form an embossed web of a material containing alkaloids; and winding the embossed web of a material containing alkaloids in a bobbin, wherein the step of embossing comprises applying an embossing pattern including a plurality of protrusions on at least a surface of the web of a material containing alkaloids, and wherein an amplitude of the plurality of protrusions is comprised between about 10 and about 150 percent of a thickness of the web of a material containing alkaloids.

2. The method according to claim 1, wherein the step of embossing comprises feeding the web of a material containing alkaloids between a first and a second embossing rollers so that the first and second embossing rollers apply an embossing pattern to at least a surface of the web.

3. The method according to claim 1, wherein the plurality of protrusions includes ridges and/or troughs.

4. The method according to claim 3, wherein the ridges and/or troughs extend in a direction orthogonal or parallel to the transport direction.

5. The method according to claim 1, wherein the plurality of protrusions has a pitch comprised between about 100 and about 500 percent of the thickness of the web.

6. The method according to claim 1, wherein the web of a material containing alkaloids has a thickness of between about 100 micron and about 300 micron.

7. The method according to claim 1, wherein the step of winding the embossed web comprises:

feeding the embossed web to a rotatable center core; and rotating the rotatable center core so as to wind the embossed web around it to form the bobbin.

8. The method according to claim 1, wherein the web of a material containing alkaloids comprises:

particles of the material containing alkaloids having a mean size comprised between about 0.03 millimetres and about 0.12 millimetres;

a binder; and water.

9. The method according to claim 1, wherein said material containing alkaloids is a tobacco material.

10. A method for producing an aerosol generating article including the step of unwinding the bobbin realized according to claim 1.

11. A bobbin of an embossed web of a material containing alkaloids realized according to claim 1.

12. A method for producing a bobbin, the method comprising the steps of:

providing a web of a material containing alkaloids, wherein the web of a material containing alkaloids contains at least about 5 percent in dry weight basis of an aerosol-former;

feeding the web of a material containing alkaloids to an embossing device in a transport direction;

embossing the web of a material containing alkaloids to form an embossed web of a material containing alkaloids; and winding the embossed web of a material containing alkaloids in a bobbin, wherein the step of embossing comprises applying an embossing pattern including a plurality of protrusions on at least a surface of the web of a material containing alkaloids, and wherein an amplitude of the plurality of protrusions is comprised between about 10 and about 150 percent of a thickness of the web of a material containing alkaloids.

* * * * *